US006962156B2

(12) United States Patent
Michaels

(10) Patent No.: US 6,962,156 B2
(45) **Date of Patent: *Nov. 8, 2005**

(54) ENHANCED PERSONAL AIR PURIFIER

(75) Inventor: Robert C. Michaels, Santa Barbara, CA (US)

(73) Assignee: Santa Barbara Medco, Inc., Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/992,391

(22) Filed: Nov. 17, 2004

(65) Prior Publication Data

US 2005/0066972 A1 Mar. 31, 2005

Related U.S. Application Data

(63) Continuation-in-part of application No. 10/665,781, filed on Sep. 19, 2003.

(51) Int. Cl.[7] ..... A61G 10/00
(52) U.S. Cl. ..... 128/206.11; 128/205.27; 128/207.18
(58) Field of Search ..... 128/205.27, 205.29, 128/206.11, 207.18; 55/DIG. 33, DIG. 35

(56) References Cited

U.S. PATENT DOCUMENTS 2,055,855 A * 6/1936 Weaver ..... 128/206.11
2,277,390 A * 3/1942 Crespo ..... 128/204.12
2,660,166 A * 11/1953 Coleman ..... 128/204.12
2,672,138 A * 3/1954 Carlock ..... 128/207.18
3,463,149 A * 8/1969 Albu ..... 128/204.12
3,722,509 A * 3/1973 Nebel ..... 128/204.12
4,215,682 A * 8/1980 Kubik et al. ..... 128/205.29
4,401,117 A * 8/1983 Gershuny ..... 128/206.11
5,486,411 A * 1/1996 Hassenboehler et al. .... 442/328
5,686,050 A * 11/1997 Wadsworth et al. ... 422/186.05
5,763,078 A * 6/1998 Braun et al. ..... 428/175
5,890,491 A * 4/1999 Rimkus ..... 128/206.11
6,484,725 B1 * 11/2002 Chi ..... 128/858
6,858,302 B2 * 2/2005 Loszewski ..... 428/408

* cited by examiner

*Primary Examiner*—Aaron J. Lewis
(74) *Attorney, Agent, or Firm*—Felix L. Fischer

(57) ABSTRACT

A personal air purifier employs tapered reticulated foam semi-cylinders sized to be closely received within a user's nostrils through slight expansion of the nostril. The semi-cylinders include a flat base with flattened surfaces circumferentially spaced about the semi-cylinder for enhanced fit within the nostril. The flat base of the two semi-cylinders is connected by an integral flexible band with arcuate edges tangentially interfacing the bases which extends across the end of the septum of the user's nose to preclude over-insertion and aid in removal. Electrostatic charging of the dielectric foam further enhances performance of the personal air purifier.

10 Claims, 5 Drawing Sheets

ENHANCED PERSONAL AIR PURIFIER

REFERENCE TO RELATED APPLICATIONS

This application is a continuation-in-part of U.S. patent application Ser. No. 10/665,781 filed on Sep. 19, 2003 entitled PERSONAL AIR PURIFIER and having a common assignee with the present invention.

BACKGROUND OF THE INVENTION

1. Field of the Invention

This invention relates generally to the field of air filtration and, more particularly, to a substantially cylindrical dielectric reticulated foam plug set for insertion into the user's nostrils for air filtration with an integral interconnecting band having improved durability.

2. Description of the Related Art

The human body is insulted by many airborne contaminants including allergens, animal dander, house dust, mites, construction dusts, ragweed pollens, rye grass pollens and other environmental pollutants. The National Institute of Allergy and Infectious Diseases estimates that 35 million Americans are plagued by upper respiratory symptoms that in many cases are allergic reactions to the airborne contaminants that are breathed every day. This is a global problem as a recently published study in the European Respiratory Journal suggested that workplace exposure may cause as much as 31% of all cases of chronic obstructive pulmonary disease, which kills more than 100,000 Americans each year.

The respiratory system of the human body is the main route for entry of contaminants such as dusts and pollens. The respiratory system includes the nose and mouth, trachea, bronchi (branching airways), and alveoli (interior surface of the lungs). The human anatomy is designed to process the airborne impurities through the nose so that the air is purified, warmed and humidified before it reaches the lungs. The hairs and mucous membranes inside the nose normally trap large particles of dirt and allergens. The trapped dirt particulate are eventually blown out the nose or coughed up. Allergens, trapped by the mucous membranes sometime cause a reaction where histamine and other chemicals are released causing swelling and nasal congestion.

Under normal conditions, particulate that bypass the nasal hairs are trapped by the fluids produced in the mucous membranes of the windpipe and bronchi and moved to the mouth by the cilia (hairlike projections that move in unison). There the particulate and dust are coughed up and spit out or swallowed.

The human respiratory system can be overwhelmed if its capacity to process airborne impurities is exceeded. Given that healthy lungs take two to three days to clear themselves after overloading, it is evident that a personal air purifier to help remove inhaled allergens and particulates has great public value.

Personal Air Purifiers generally fall into two categories: Type 1—those which cover both the nose and mouth and type 2—those which cover a portion of the nose or are insertable in the nostrils.

Regarding type 1, those that cover both the nose and mouth are uncomfortable because they trap heat and cause the face to sweat, especially during heavy exertion. They also make eating and drinking impossible, make talking difficult and make the use of spectacles both uncomfortable and dangerous due to fogging.

Regarding type 2, the prior art teaches a variety of nostril insertable filters or partial nose covering gloves, for example, those disclosed in U.S. Pat. Nos. 4,030,491; 4,220,150; 4,573,461; 5,117,820; 5,568,808; 5,636,629; 5,740,798; 5,890,491; 6,216,694 B1 and D451,193 S.

U.S. Pat. No. 4,030,491 to Mattila teaches the use of a pair of containers with separate filters and covers. Unlike the present invention there are seven small, difficult-to-handle pieces, the plastic housings are not conformable to the inside of the nose and it is difficult for the housings to suit different size nostrils. The difficulty in establishing a proper fit facilitates blowby, the passage of unfiltered air between the outside of the housing and the inside of the nose. Mattila also teaches that the housings are reusable possibly leading to contamination by biologics which may be present in the nose including rhinoviruses, adenoviruses, (which lead to respiratory infection), parainfluenza, and bacteria.

U.S. Pat. No. 4,220,150 issued to King teaches the use of a clip that clamps the interior septum wall as a structure to support two plastic, ball mounted filter cups. Unlike the present invention the use of a septum clip is uncomfortable and may be impossible to use in the event of a deviated septum or other physiological aspect. King teaches that the filter cups swivel to fit the interior of the nose. The cups may not filter efficaciously if they are not exactly aligned facing the incoming air. If not properly in position, blowby may occur reducing filter efficiency drastically. All of the assemblage that King teaches including the structure necessary to hold the septum clip and filter housing drastically reduces the nostril air flow area thereby creating a higher breathing resistance.

U.S. Pat. No. 4,573,461, Lake, teaches the use of an oblong ellipsoid-shaped solid material to block off the nasal cavities for a specific time and then a porous material to function as a filter. Unlike the present invention the solid insert is used for a period of 30 minutes or more to block off the airflow through the nose and then the solid shapes are removed and the porous material shapes inserted. The use of a solid insert does not allow air to pass into the lungs and hence does not provide an air purifying effect.

U.S. Pat. No. 5,117,820, Robitaille, teaches the use of two cylindrical synthetic spongy materials with one black end on each cylinder, said cylinders being compressed by the application of vacuum prior to inserting in the nostrils. Unlike the present invention, a source of vacuum is required to compress the material prior to insertion, the spongy material is not identified, there is no physical restraint to prevent over or under insertion into the nostril and no characteristic to determine where within the nostril it should be placed.

U.S. Pat. No. 5,568,808 issued to Rimkus teaches the use of two separate housings each containing a filter material. Said housing is inserted in each nostril and a flutter valve forms a seal with the lower portion of the nostril. The intent is to force inhalation air to pass through the filter media rather than blow by the housing while exhalation air bypasses the housing and escapes through the flutter valve. Unlike the present invention it is difficult to position the housing to seal on the exterior edges of the nostril, there are four small, difficult-to-handle pieces, the housings are not conformable to the inside of the nose and it is difficult for the housings to fit different size nostrils thereby facilitating blowby. Rimkus also teaches that the housings may be reusable possibly leading to contamination which may be present in the nose including rhinoviruses, adenoviruses, parainfluenza, pollens and bacteria.

U.S. Pat. No. 5,636,629 issued to Patterson, Jr. teaches the use of a nasal glove consisting of filter material circumscribed with a flexible material which is bent to conform with the shape of the exterior of the nose to hold the glove in place. Unlike the present invention that seals around the interior nasal vestibule, there is no sealing at the juncture of the nostril and upper lip thereby allowing air to bypass the filter media. The filter media and efficacy are not well described and it is difficult for the housings to fit different size noses thereby facilitating blowby at the top and sides of the nose.

U.S. Pat. No. 5,740,798 issued to McKinney teaches an air filter worn over the end of the nose that consists of a filter element which is preferably made of a thermal fleece or a thermal undergarment material which is held to the nose by a combination of an elastic strand and adhesive strips. Unlike the present invention, which seals inside the nasal vestibule, it is extremely difficult to seal airflow to the exterior nose with elastic bands thereby facilitating blowby. McKinney also teaches that a thermal undergarment material is a suitable filter material but does not identify the efficacy of such undergarment for filtration applications.

U.S. Pat. No. 5,890,491 issued to Rimkus, teaches that the flapper valve of U.S. Pat. No. 5,568,808 is not efficacious and that the nose filters housing and flange becomes fixedly attached inside the nostril through an adhesive component. Unlike the present invention the use of an adhesive on the sensitive membranes of the nose could be an irritant as well as painful when the housings are removed. Rimkus also teaches that the filter element fits inside the housing and is disposable. Unlike the present invention the housings are not conformable to the inside of the nose, it is difficult for the housings to fit different size nostrils thereby facilitating the passage of air between the outside of the housing and the inside of the nose. Rimkus also teaches that although the filter media is disposable, the housings are reusable possibly leading to contamination that may be present in the nose including rhinoviruses, adenoviruses, parainfluenza, pollens and bacteria.

U.S. Pat. No. 6,216,694 B1 issued to Chen teaches an insertable, conical, hollow nose plug with two separate active carbon air filters in the proximal (exterior) end of each conical hollow. Unlike the present invention, the filter media is placed only at the proximal end of the hollow cones and consequently is of small volume and therefore has a small contaminant handling capacity. The two separate filters must be sized for the proximal end of the hollow cone and the description of the filter media is unclear. Chen also teaches that the distal (interior) end of the conical tube may have a slanted plane and a tapered conical shape. It may be difficult to align the plane to the nasal bridge as the planes are not visible when inserted in the nose. The sharp plane may impact the sensitive areas of the inside of the nose causing irritation and discomfort while the tapered distal end may restrict airflow leading to an increase in breathing resistance.

U.S. Pat. No. D451,193S issued to McCormick, teaches of a shape for an insertable nasal filter whereby the filter elements are inserted into the housings. Unlike the present invention, the plastic housings are not conformable to the inside of the nose, it is difficult for the housings to fit different size nostrils thereby facilitating the passage of air between the outside of the housing and the inside of the nose. McCormick teaches that there are holes on the distal (interior) end of the housing. The total area of the holes in the distil side of the housing as compared to the proximal side is much less causing a reduction in air flow and corresponding increase in air bypassing the filter. In addition, reusable filter housings can lead to contamination that may be present in the nose including rhinoviruses, adenoviruses, parainfluenza, pollens and bacteria.

None of the above referenced inventions either singly or in concert is seen to describe and explain the present invention.

A desired aspect of a personal air purifier is to provide a method for purifying the air inhaled through the nose by providing a reticulated foam filter shaped to be soft and gentle to the interior of the nose while effectively preventing airborne contaminates such as allergens, animal dander, house dust, mites, construction dusts, ragweed and rye grass pollens and many environmental pollutants from entering the respiratory system.

Unlike previous inventions, where the filter media is a separate piece affixed to an assembly or inserted into a housing, it is desirable that the purifier consists of a single filter material molded into a shape that can be easily and safely inserted into and removed from the interior of the nose and nostrils. A unitary design provides the maximum surface area and volume for maximum airflow and filter efficacy.

Another desirable feature of a new and improved personal air purifier is that when fully seated within the nostrils its appearance will be aesthetically pleasing.

It is further desirable to provide a personal air purifier that will remain in place during eating, drinking, talking and heavy exertion but may be expelled in the event of an explosive sneeze.

Additionally it is desirable to provide a personal air purifier that is easily manufactured, and intended for daily use thereby minimizing the opportunity to reinsert in the nose a unit contaminated with viruses, bacteria and allergens.

It is also desirable to provide a simple, low cost, disposable, portable air purifier that can be economically used by all members of society.

It is also desirable to utilize the natural ability of foam to expand, fill and form the nostril area thereby sealing the purifier within the nostrils, eliminating blowby and providing maximum filtering area.

Further, it is desirable to utilize the inherent ability of the foam to apply gentle pressure to expand the outer nasal wall tissues from the septum structures thereby providing nasal dilation, increased air flow and subsequent filtering efficacy.

Still further, it is desirable to provide a personal air purifier of the depth filter type which will capture and hold contaminates by providing a tortuous path for the air flow to follow as it passes through the filter media.

Stress risers may occur in an area of the thin flexible material at which stress will tend to be concentrated. Since a stress riser is normally at a sharp edge, the area where an interconnecting band and cylinder join is a potential location for a local stress riser. When the band is mechanically strained the joint is under tension and the stress riser becomes an initiation point for a tear failure. It is therefore desirable that interconnections of elements in a personal purifier avoid geometries which induce stress risers.

SUMMARY OF THE INVENTION

The present invention consists of two semi-cylinders of dielectric reticulated foam filter media with a spherical shape on the distal (interior nose) end and a flat surface on the proximal end joined to each other at the proximal end with a thin flexible band. The thin flexible band is integrally molded with the semi-cylinders and is made from the same material and at the same time as the semi-cylinders.

The distal, spherical shaped end of each semi-cylinder is intended to be inserted in the nostril and located just inside and within the nasal vestibule. The spherical end guides the air purifier into position and prevents damage to delicate nasal membranes. The proximal end is tucked in within the nasal vestibule just behind where the ala of the nostril narrows. The flexible band prevents overinsertion of one or both of the semi-cylinders and serves as a handle to remove the air purifier from the nose.

The reticulated foam is a dielectric material that upon exposure to the air stream formed during the inhalation of air into the nostrils will generate an electrostatic charge that is capable of attracting and holding micron sized particulate and allergens within the foam intricacies of the filter material.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1:
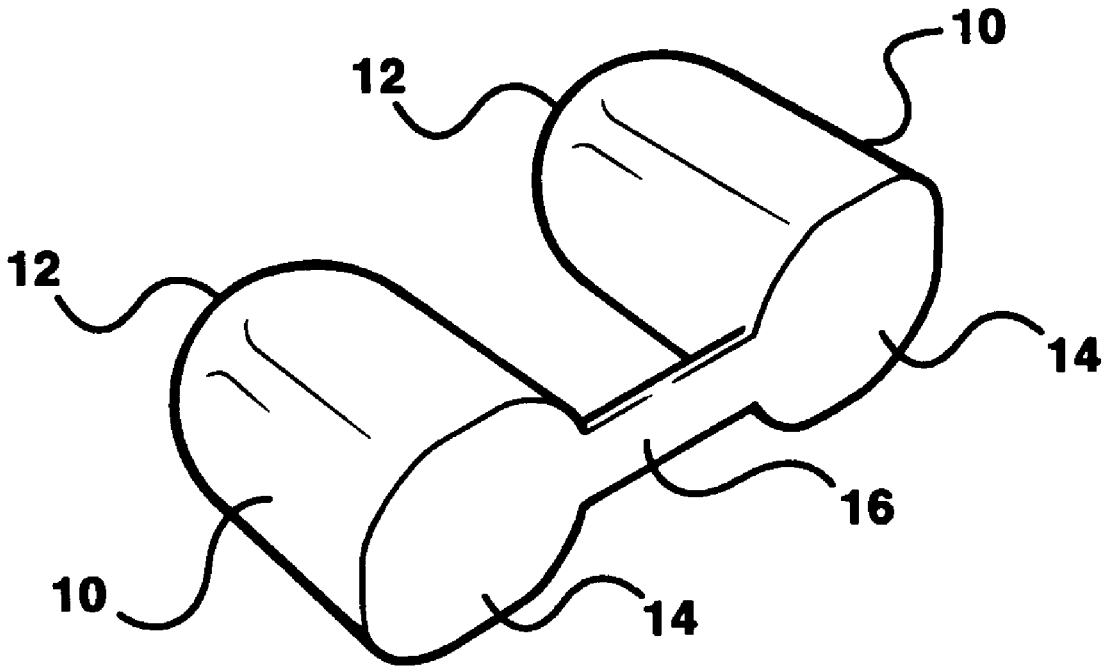
FIG. 1 is a top, front, left side perspective view of the personal air purifier of the present invention.

Referring to the drawings, FIG. 1 shows an embodiment of the invention that incorporates two semi-cylindrical shapes 10 of the same nominal diameter, which have at each distal end a spherical shape 12 to match and blend with the nominal semi-cylindrical diameter and at each other proximal end a base 14 with a flat surface whose plane is perpendicular to the cylinder axis. A thin, strong, flexible band 16 made of the same material as the semi-cylinders joins the semi-cylindrical shapes. The entire assembly is made from the same dielectric material, reticulated foam of the polyurethane or silicone chemical family and of the polyether or polyester category.

The manufacturing process for the present invention consists of first producing the foam by a chemical reaction process and then removing the cell walls within the foam by a thermal or chemical process thereby producing reticulated foam. The reticulated foam consists of a three dimensional matrix with voids and intricacies within a skeletal structure.

The reticulation process removes the cell walls, leaving only a structure of skeletal strands and voids. This makes the reticulated foam exceptionally porous and to permeable but with many particulate catching strands and great contaminate holding capacity within the void spaces.

The reticulated foam manufacturing process is well understood by those skilled in the field, such as Foamex Inc., Linwood, Pa. and Lendell Manufacturing Inc., St. Charles, Mich. and results in a foam with consistent properties including density, tensile strength, tear strength, elongation, compression set, pore size (ppi-pores per inch) and dielectric nature.

The pores per inch specification relates directly to the air purifying efficaciousness, with a higher number relating directly to greater filtering ability and a greater breathing resistance. Current embodiments of the present invention are molded using reticulated foam of from 40 to 130 ppi so that the user may choose the best filtering characteristic based on individual need.

The reticulated foam is manufactured in large sections approximately six feet by four feet by one foot thick and then supplied to a foam fabricator skilled in the field such as Illbruck Inc., Minneapolis, Minn. For current embodiments, the fabricator slits the foam to the appropriate thickness of about 0.65 inch with a 48 inch by 72 inch sheet, saws the sheet to the handling blocks of about 12 inches and then die-cuts the blocks to produce individual precurser blocks of 1 inch by 2 inches by 0.65 inch which are then further die-cut to shape approximating the semicylinders and connecting band suitable as a preform for the molding process. The preform is then placed in a mold and, utilizing heat and pressure, the net shape of the product incorporating the present invention is produced including a felting step to compress the connecting band. The product is ready for use when it comes from the mold, no secondary manufacturing procedures are necessary.

Figure 2:
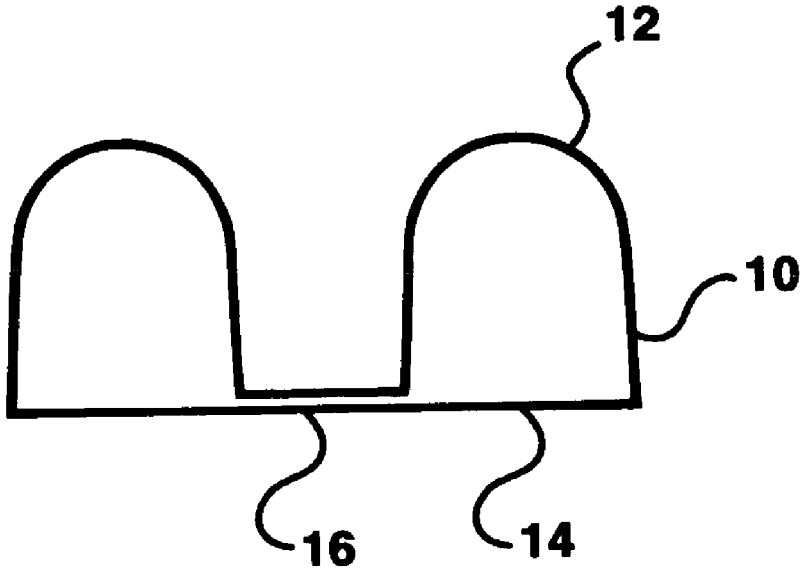
FIG. 2 is a front elevation view of the air purifier of FIG. 1, the rear view being a mirror image thereof.
Figure 3:
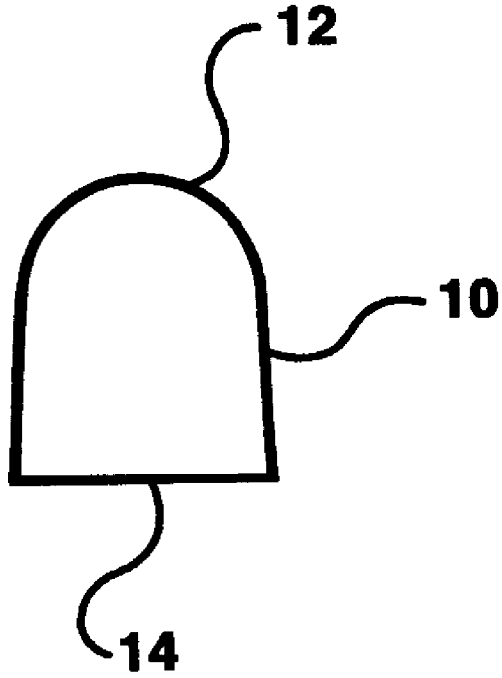
FIG. 3 is a right side elevation view of the air purifier of FIG. 1, the left side elevation being a mirror image thereof.

Referring to FIGS. 2 and 3, there is a slight tapering of the semi-cylindrical shape from the proximal end or base 14 to the beginning of the spherical shape 12 providing a frusto-conical section. This taper and the rounding at the vertex of the distal end of the spherical shape 12 allows for an easier insertion into the nose by guiding and gently expanding and forming the nostrils during insertion.

Figure 4:
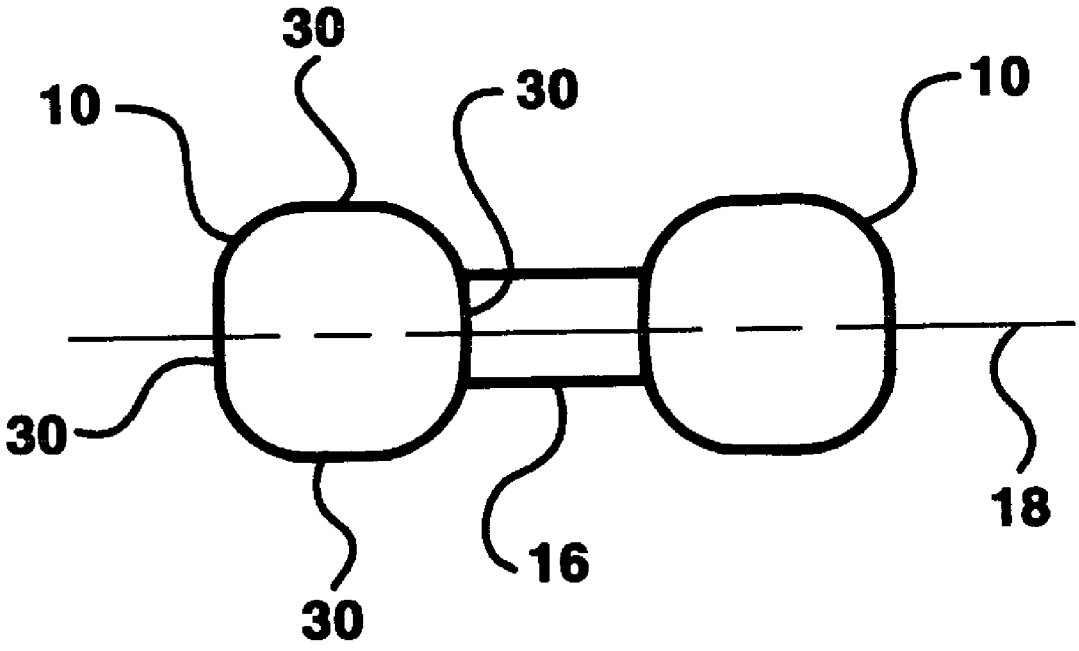
FIG. 4 is a top plan view of the air purifier of FIG. 1.

Referring to FIGS. 2 and 4 the thin flexible band 16 is integrally molded to the proximal end 14 of the semi-cylindrical shapes and coincident with the centerline 18 that joins the centers of the faces at the base 14 of the proximal ends of both semi-cylindrical shapes 10. The thin flexible band 16 has one surface in the same plane as the flat surface of the base 14 of the semi-cylindrical shapes and the other surface in a parallel plane a small distance away from the proximal end plane.

Figure 6:
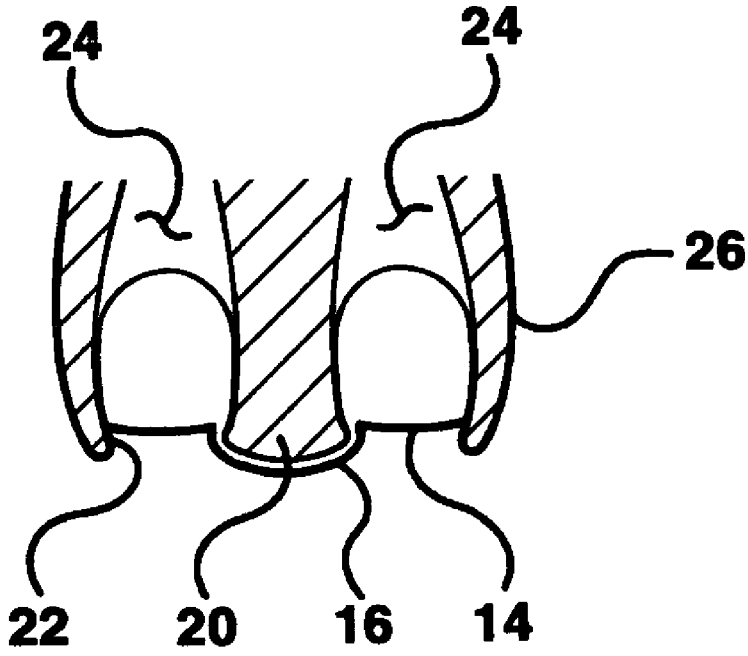
FIG. 6 is an elevation section view of the personal air purifier of the present invention inserted in the nostrils.

Referring to FIGS. 2, 4 and 6, the thin flexible band 16 is substantially thinner and narrower than the semi-cylindrical shapes thereby allowing great conformability to the exterior of the end of the nasal septum 20. This conformity allows the base 14 of the proximal end of the semi-cylindrical shapes to be placed within the nasal vestibule just behind the narrowing of the nostril, the ala 22. This restrains the personal air purifier so that it will not be dislodged by normal activities such as talking and eating, and still release under the pressures of an explosive sneeze.

Figure 7:
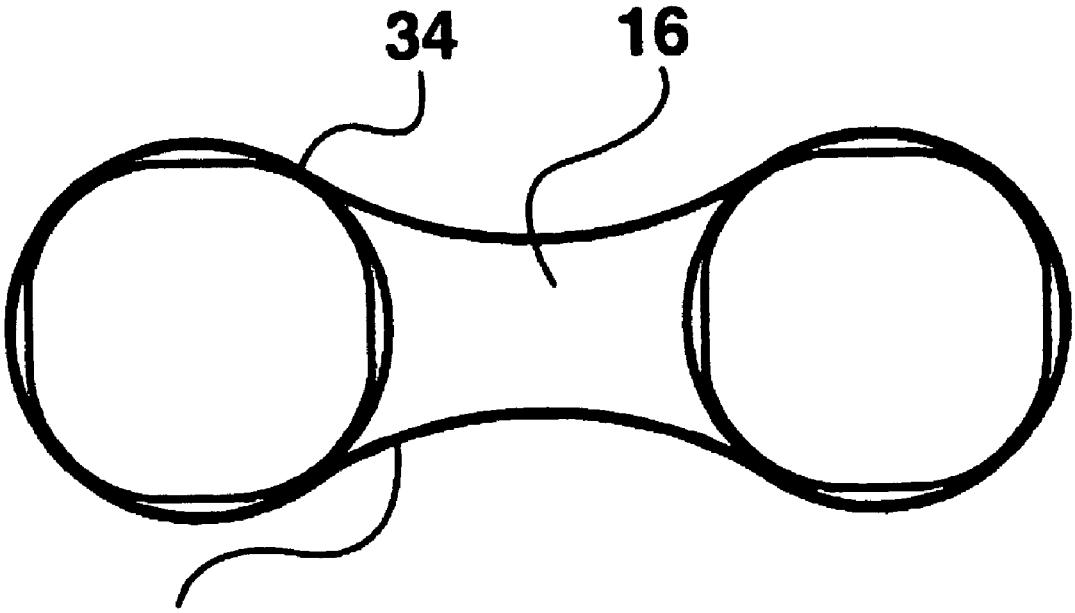
FIG. 7 is a plan view of an alternative embodiment of the thin flexible band that joins the semi-cylindrical shapes.
Figure 8:
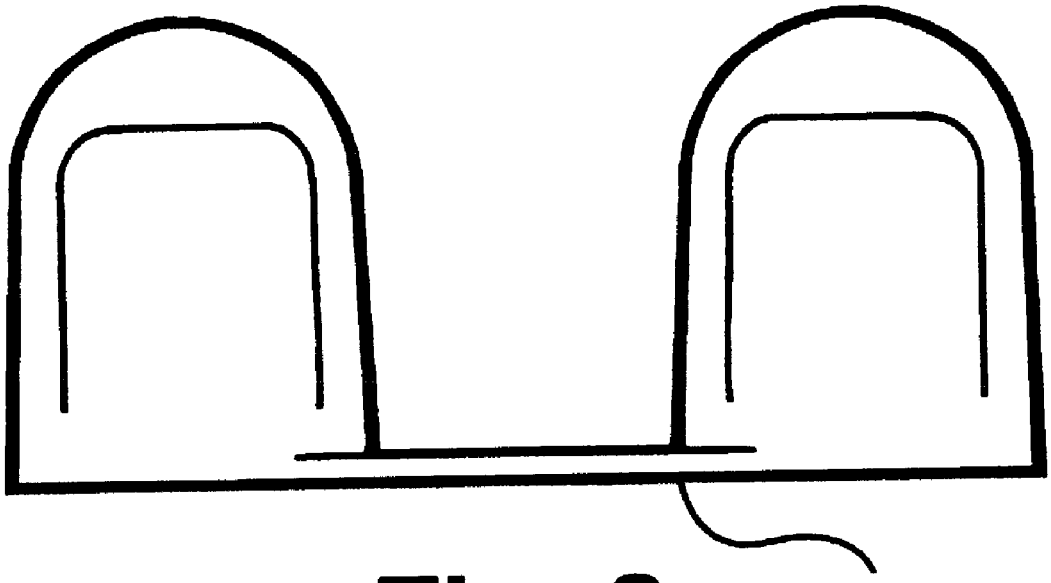
FIG. 8 is a front elevation of the thin flexible band of FIG. 7.

FIGS. 7 and 8, show an alternative embodiment of the thin flexible band 16 that resolves the potential for a stress riser to be present at the convergence of the band and the semi-cylindrical shapes thereby enhancing the mechanical aspects of the invention for greater durability. For example, a stress riser could develop at the place where the rectangular cross sectional band 16, is joined to the rounded shape of the semi-cylinders 10 as shown in FIG. 1 when stress is induced between the band and semi-cylindrical shapes such as during removal of the personal air purifier. Increasing the band 16 cross-sectional area at the band cylinder joint and matching the round shape of the semi-cylinders 10 eliminates the potential stress riser. Referring to FIG. 7, the area of the interconnecting band is increased by changing the band sides to arcuate shapes 32 while maintaining the same thickness. A substantially tangential interface between the arcuate entry 34 on the band and the semi-cylindrical base further enhances stress riser elimination. The band shape therefore distributes any load over a greater area by substantially matching the rounded shape of the semi-cylinders. This then distributes the stress over a larger area and to reduce the possibility of tearing.

Referring back to FIG. 3, the distance from the flat surface of the base to the vertex of the distal end spherical shape 12 is approximately 110% of the average semi-cylindrical diameter and represents the total length of filtering media. In an exemplary embodiment the nominal diameter is 0.56 inches and the typical length is 0.62 inches. This length, times the semi-cylinder area provides an extremely large volume of filter media to trap and hold the particulate and allergens.

Referring to FIG. 4, the semi-cylindrical shape has a slightly flattened surface 30 on all four sides to better match the ovoid shape of the nostrils. The slightly flattened sides of the cylinders are spaced circumferentially around the frustoconical semi-cylinder and smoothly blended with the spherical shape 12 to assure a gentle yet retained fit within the nostrils.

Figure 5:
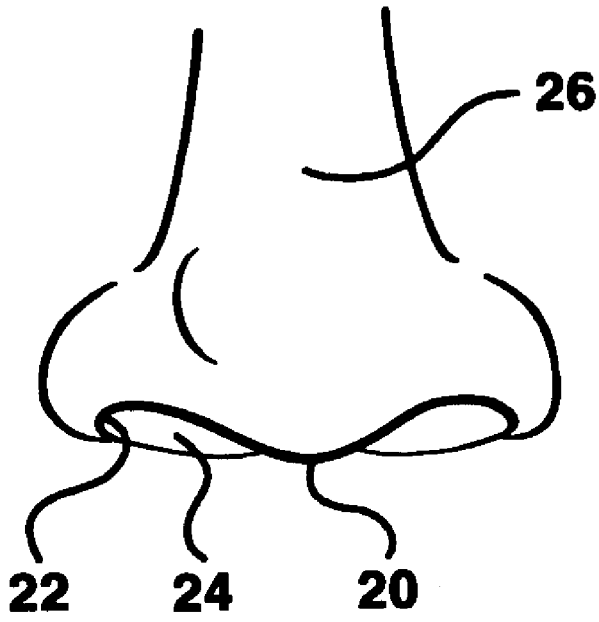
FIG. 5 is a view of the personal air purifier of the present invention inserted in the nostrils.

Referring to FIG. 5, when installed the personal air purifier dilates the air passages in the nostrils 24 of the nose 26 to achieve a result similar to adhesive dilators that are affixed to the exterior of the nose. The foam expansion presents a larger filter surface area and, as a consequence, lower face velocity across the filter resulting in greater filter efficiency.

Referring to FIG. 6, the proximal ends of both semi-cylindrical shapes expand the nostril to conform to the shape, secure the personal air purifier to the nostril and assure that all the inhaled air passes through the reticulated air filter. The adaptability, softness and gentle expansion ability of the foam makes a nominal size suitable for many people. It is understood that the size of the personal air purifier may be varied to accommodate noses of other shapes and sizes.

Figure 9:
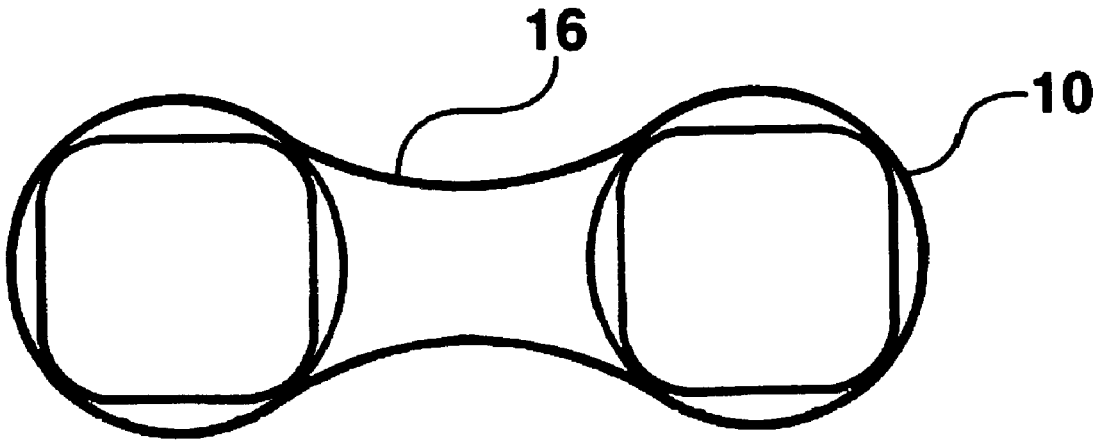
FIG. 9 is a plan view of an alternative embodiment of the inserted end of the semi-cylindrically shaped plugs; and, FIG. 10 is a front elevation of the semi-cylindrical shapes of FIG. 7.
Figure 10:
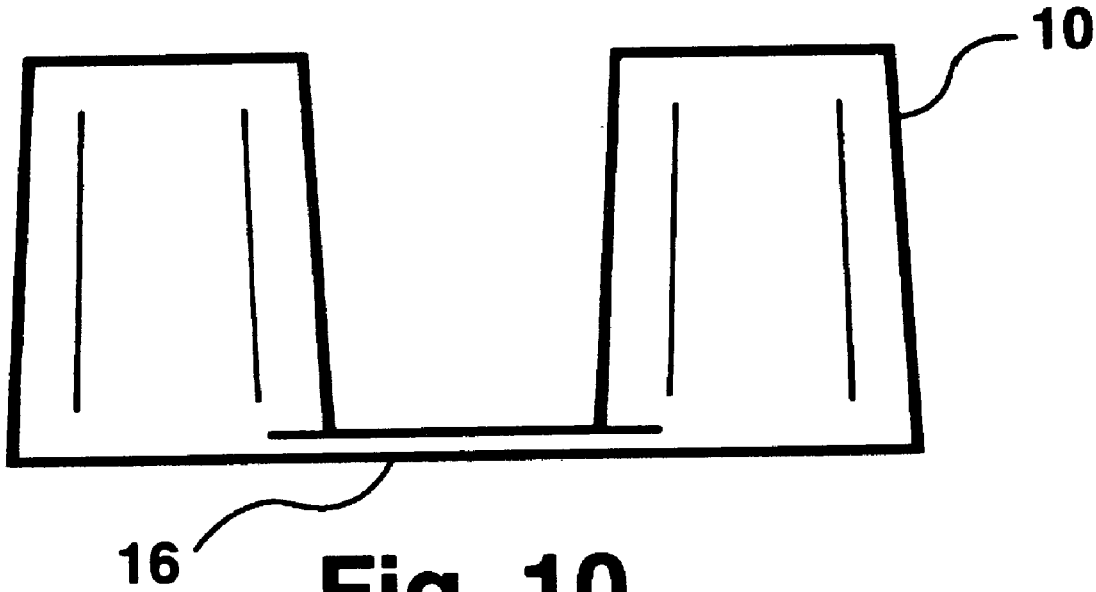

FIG. 9 shows the plan view and FIG. 10 the front elevation view of an alternative embodiment of the invention in which the spherical shape of the prior embodiments at the distal end of the semi-cylindrical shapes is flattened. The shape of the inserted portions of the personal air purifier is a modified frustum formed between two parallel plates cutting the semi-cylindrical shape 10 at the base and a plane parallel to the base.

The frustum embodiment shown in FIGS. 9 and 10 is appropriate if it is desired to use an inexpensive method (such as a punch and die set) to fabricate the semi-cylindrical shapes 10. The band 16 is attached in a secondary operation.

Referring to FIGS. 9 and 10 again, the modified frustum embodiment offers approximately 33% greater filter volume than the spherical shape since the circumferential corner 36 of the frustum is not rounded. The flattened sides 30 circumferentially spaced about the semicylindrical shapes 10 are retained to provide the enhanced fit within the nostril.

The dielectric material employed in the personal air purifier as described above provides a passive charge accumulation capability to assist in entrapment of particles within the filter material. However, enhanced capability of the personal air purifier of the present invention is achieved by treating the dielectric reticulated foam with an electrostatic field to increase particulate removal efficiency. An electrostatic charge is applied to the personal air purifier after molding but prior to packaging thereby making the filter media an electret or filter media to which an electrostatic charge is applied during its formation.

All atoms have a nucleus, which contains positively charged protons and uncharged neutrons. Exactly balancing the charge of the protons are negatively charged electrons orbiting the nucleus. Each atom has an equal number of protons and electrons and hence a neutral charge. If electrons are lost from the atom, the atom becomes a positively charged ion. If electrons are gained, the atom becomes a negatively charged ion. The unbalanced condition, either positive or negative, creates electrostatic forces—the most common form being static electricity.

Various materials have a tendency to either give up or gain electrons. A listing of these materials and how easily they gain a net positive or negative charge is called the Triboelectric Table. In the table, dry human skin, rabbit fur and human hair readily give up electrons and become positively charged ions. Therefore a negatively charged personal air purifier will have a tendency to attract and hold positively charged ions.

Dust, dander and other particulates normally have either a positive or negative charge because routine contact and separation can so easily electrically charge them. Electrostatic charges can be built up by quickly stripping apart items that are in intimate contact or rubbing together two non conductors or in fact by any relative motion between the two materials.

Because they are so common, it is likely that dust, dander and particulate from the positive ion materials listed in the Triboelectric Table are positively charged. Therefore, the personal air purifier performance is enhanced by applying a net negative charge.

Ion generating equipment such as the Dyne-A-Mite Blown Arc Air Plasma System as manufactured by Enercon Industries Corporation, Menomonee Falls, Wis. and the Chargemaster Electrostatic Charging System as manufactured by Simco Corportion, Hatfield, Pa. are capable of applying a sufficient negative electrostatic charge to the personal air purifier up to a maximum of 50,000 volts. During the manufacturing process and after molding, the personal air purifier is passed through a high voltage, low current electrostatic field and the charge placed instantaneously. Once the negative charge is applied, the personal air purifier is placed in non-conductive packaging to prevent the charge from dissipating prior to use.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A personal air purifier for insertion in a user's nose compnsing:

two semi-cylinders of porous foam filter media each having a base with a flat surface and an end distal from the flat surface wherein the semi-cylinders have a plurality of circumferentially spaced flattened surfaces intermediate the base and distal end; and, a thin flexible band integrally molded with the semi-cylinders and extending between the bases, the band having arcuate edges with a substantially tangential interface to the bases of the semi-cylinders;

the semi-cylinders sized such that upon insertion in a nostril the distal, end of each semi-cylinder is located inside the nasal vestibule and the base of each semi-cylinder is tucked in within the nostril just behind the ala, the flexible band extending over the end of the septum of the nose preventing overinsertion of one or both of the semi-cylinders and serving as a handle to remove the air purifier from the nose.

2. A personal air purifier as defined in claim 1 wherein the foam filter media is a dielectric.

3. A personal air purifier for insertion in a user's nose comprising:

two semi-cylinders of foam filter media each having a base with a flat surface and a spherical shape on an end distal from the flat surface, the semi-cylinders tapered from the base toward the distal end, and have a plurality of circumferentially spaced flattened surfaces intermediate the base and distal end; and, a thin flexible band integrally molded with the semi-cylinders and extending between the bases, the band having arcuate edges with a substantially tangential interface to the bases of the semi-cylinders;

the semi-cylinders sized such that upon insertion in a nostril the distal, spherical shaped end of each semi-cylinder is located just inside and within the nasal vestibule and the base of each semi-cylinder is tucked in within the nostril just behind the ala, the flexible band extending over the end of the septum of the nose preventing overinsertion of one or both of the semi-cylinders and serving as a handle to remove the air purifier from the nose.

4. A personal air purifier as defined in claim 3 wherein the foam filter media is reticulated foam.

5. A personal air purifier as defined in claim 3 wherein the foam filter media is a dielectric.

6. A personal air purifier for insertion in a user's nose comprising:

two semi-cylinders of dielectric reticulated foam filter media each having a base with a flat surface and a spherical shape on an end distal from the flat surface wherein the semi-cylinders have a plurality of circumferentially spaced flattened surfaces intermediate the base and distal end; and, a thin flexible band integrally molded with the semi-cylinders and extending between the bases, the band havin arcuate edges with a substantially tangential interface to the bases of the semi-cylinders;

the semi-cylinders sized such that upon insertion in a nostril the distal, spherical shaped end of each semi-cylinder is located just inside and within the nasal vestibule and the base of each semi-cylinder is tucked in within the nostril just behind the ala, the flexible band extending over the end of the septum of the nose preventing overinsertion of one or both of the semi-cylinders and serving as a handle to remove the air purifier from the nose.

7. A personal air purifier for insertion in a user's nose comprising:

two semi-cylinders of porous foam filter media each having a base with a flat surface, a flat surface on an end distal from the base and a plurality of circumferentially spaced flattened surfaces intermediate the base and distal end; and, a thin flexible band attached to the semi-cylinders and extending between the bases, the band having arcuate edges with a substantially tangential interface to the bases of the semi-cylinders;

the semi-cylinders sized such that upon insertion in a nostril the distal end of each semi-cylinder is located inside the nasal vestibule and the base of each semi-cylinder is tucked in within the nostril just behind the ala, the flexible band extending over the end of the septum of the nose preventing overinsertion of one or both of the semi-cylinders and serving as a handle to remove the air purifier from the nose.

8. A method for enhancing performance of a personal air purifier comprising the steps of:

fabricating a net shape having two semi-cylinders of dielectric reticulated foam filter media each having a base with a flat surface and an end distal from the flat surface wherein the semi-cylinders have a plurality of circumferentially spaced flattened surfaces intermediate the base and distal end and, a thin flexible band integrally molded with the semi-cylinders and extending between the bases; and, charging the net shape with an electrostatic charge.

9. A method for producing a personal air purifier as defined in claim 8 further comprising the steps of packaging the net shape in a non-conductive package to reduce charge dissipation.

10. A method for producing a personal air purifier as defined in claim 8 wherein the step of charging includes the step of passing the net shape through a high voltage low current electrostatic field.

* * * * *